US012448752B2

(12) United States Patent
Thompson et al.

(10) Patent No.: US 12,448,752 B2
(45) Date of Patent: Oct. 21, 2025

(54) WORK TOOL POSITION CONTROL

(71) Applicant: Caterpillar Inc., Peoria, IL (US)

(72) Inventors: Mark William Thompson, Manhattan, KS (US); Aaron Dean Kovar, Topeka, KS (US)

(73) Assignee: Caterpillar Inc., Peoria, IL (US)

( * ) Notice: Subject to any disclaimer, the term of this patent is extended or adjusted under 35 U.S.C. 154(b) by 243 days.

(21) Appl. No.: 18/142,832

(22) Filed: May 3, 2023

(65) Prior Publication Data

US 2024/0368855 A1 Nov. 7, 2024

(51) Int. Cl.
*E02F 3/43* (2006.01)

(52) U.S. Cl.
CPC ..... *E02F 3/437* (2013.01)

(58) Field of Classification Search
CPC ... E02F 3/32; E02F 3/404; E02F 3/425; E02F 3/437; E02F 3/435; E02F 3/4135; E02F 3/361; E02F 9/2004; E02F 9/09; E02F 9/2203; E02F 9/2221; E02F 9/2267; E02F 9/2278; E02F 9/264; E02F 9/265
USPC ..... 701/22, 50
See application file for complete search history.

(56) References Cited

U.S. PATENT DOCUMENTS

| | | | | |
|---|---|---|---|---|
| 6,148,254 | A * | 11/2000 | Barden | E02F 3/435 701/50 |
| 6,450,081 | B1 | 9/2002 | Sorbel | |
| 9,555,706 | B1 * | 1/2017 | Mitchell | B60W 10/02 |
| 10,711,431 | B2 | 7/2020 | Zent et al. | |
| 10,801,180 | B2 | 10/2020 | Sherlock | |
| 11,905,678 | B2 * | 2/2024 | Jonsson | E02F 3/404 |
| 12,098,527 | B2 * | 9/2024 | Daimon | E02F 9/2029 |
| 2011/0004379 | A1 | 1/2011 | Murota | |
| 2021/0095441 | A1 | 4/2021 | Jonsson | |
| 2022/0002978 | A1 * | 1/2022 | Kurosawa | G06V 10/82 |
| 2022/0025608 | A1 * | 1/2022 | Itoh | E02F 9/2282 |
| 2022/0025616 | A1 * | 1/2022 | Kean | E02F 9/2012 |
| 2023/0056030 | A1 * | 2/2023 | Wang | E02F 9/2004 |
| 2023/0279646 | A1 * | 9/2023 | Kikani | E02F 9/262 701/50 |

OTHER PUBLICATIONS

Written Opinion and International Search Report for Int'l. Patent Appln. No. PCT/US2024/023182, mailed Jul. 30, 2024 (11 pgs).

* cited by examiner

*Primary Examiner* — Andrew Joseph Rudy

(57) ABSTRACT

A work tool position control for a work machine is disclosed. A bucket control is used to adjust the bucket of the work tool relative to an arm of a work machine. A controller receives a bucket movement signal from the bucket control and moves the bucket. A thumb position sensor is used to measure an opening angle between a thumb of the work tool and the bucket, and the measured opening angle is sent from the thumb position sensor to the controller prior to the controller moving the bucket.

20 Claims, 6 Drawing Sheets

WORK TOOL POSITION CONTROL

TECHNICAL FIELD

The present disclosure generally relates to a work machine and, more particularly, relates to a work tool position control for a work machine.

BACKGROUND

In construction, heavy machinery such as excavators and electric mining shovels are typically utilized to remove earthen materials. In general, these construction machines have a traversing body and a revolving body that is rotatable relative to the traversing body in order to rotate a work tool attached to the rotating body. The work tool is often attached to the rotating body by a linkage that may include a boom and an arm. Many of these work tools are buckets that have integrated thumbs that are moveable between fully open and fully closed positions. However, because the thumb's actuators are attached directly to the bucket, any curling of the bucket towards the arm can cause the thumb to contact the arm if the thumb is in any working or open position. Further, because of this risk of damaging the arm, or other parts of the work machine, the thumb must be removed from the work tool when the thumb is not needed.

U.S. Pat. Pub. No.: 2021/0095441 A1 discloses a control system for an excavator that is arranged to control a tiltrotator to rotate and/or tilt an auxiliary tool between a plurality of first positions and at least one second position. The control system has a first blocker that is arranged to block movement of the thumb when the auxiliary tool is rotated away from the thumb.

While effective, there remains a need for improved work tool controls, such as on construction machines in the construction industries.

SUMMARY

In accordance with one aspect of the present disclosure, a work tool position control is disclosed. The control system has the control system has a bucket control for controlling movement of a bucket of a work tool of a work machine by sending a bucket movement signal to a controller. A thumb position sensor is used to measure an opening angle between a thumb of the work tool and the bucket, and the position sensor sends the measured opening angle to the controller. The controller receives the measured opening angle and moves the bucket in response to the bucket movement signal.

In accordance with another aspect of the present disclosure, a work machine is disclosed. The work machine has a base body that is supported on a ground surface, and a revolving frame that is rotatable around an axis of the base body. A bucket of a work tool is connected to an arm of the work machine, and can be positioned by a bucket control. A thumb of the work tool can rotate relative to the bucket, and can be positioned by a thumb control. A controller is used to move the bucket after receiving a bucket movement signal from the bucket control. Before moving the bucket, the controller monitors a thumb position sensor that is used to measure an opening angle between the thumb and the bucket.

In accordance with a further aspect of the present disclosure, a method for autonomously repositioning a thumb of a work machine relative to a bucket is disclosed. The method includes providing a work tool position control that has a bucket position sensor, a thumb position sensor, and a controller. The work tool position control rotates the bucket relative to an arm of the work machine after receiving a bucket movement signal. Prior to rotating the bucket relative to the arm, the method includes the controller monitoring an output of the bucket position sensor and an output of the thumb position sensor, and the controller calculating a future bucket position. The method further includes moving the thumb to avoid interference of the thumb with the arm as the bucket is rotated in response to the movement signal.

These and other aspects and features of the present disclosure will be more readily understood when read in conjunction with the accompanying drawings.

DETAILED DESCRIPTION

Figure 1:
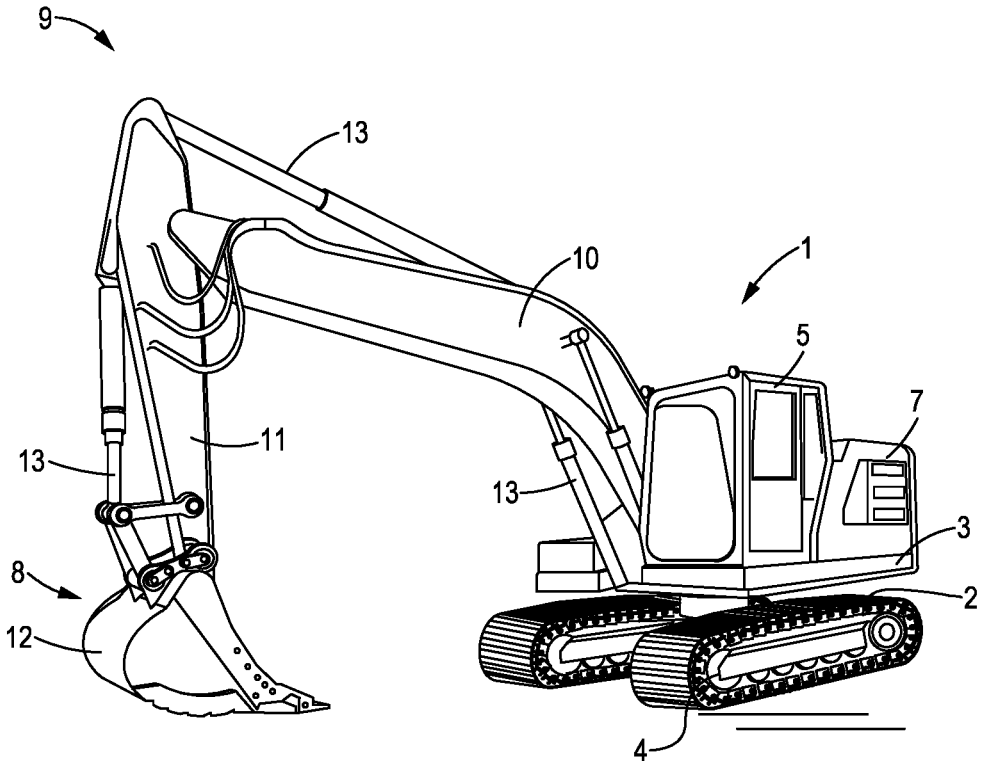
FIG. 1 is a side view of an exemplary work machine, in accordance with the present disclosure.

Referring to FIG. 1, a work machine 1 is shown. The work machine 1 may embody a fixed or mobile machine that performs some type of operation associated with an industry such as construction, mining, farming, transportation, or other industries known to utilize heavy equipment. For example, the work machine 1 may be an earth moving machine such as an excavator, as shown, or a motor grader, electric mining shovel, backhoe, a dozer, a loader, a truck, or any other earth moving machine.

The work machine 1, as shown as an excavator in the FIG. 1 exemplary embodiment, includes a base body 2 that is supported on a ground surface. The base body 2 supports a revolving frame 3 that is slewably attached to the base body 2, and the revolving frame 3 being up to 360 degrees rotatable relative to an axis of base body 2. The base body 2 is supported on a crawler-type lower traveling body 4, but in another exemplary embodiment, the traveling body 4 may support wheels or other movement supporting means. An operator cab 5 containing the operator controls 6 (FIG. 5) necessary to operate the work machine 1 is mounted on the revolving frame 3. The operator controls 6 may contain any screens, gauges, lights, etc. for displaying operational information of the work machine, alarms, or any statuses of the work machine. The operator controls 6 further may contain any of the controls for controlling the implements (discussed below), frame, linkages, or any of the movements of any part of the work machine 1. The operator controls 6, in one exemplary embodiment, are designed to receive an input (discussed below) from an operator of the work machine, either located in the operator cab 5 or an operator remotely operating the work machine 1, and send movement signals, some of which are discussed below, to the controller (discussed below) of the work machine 1.

The revolving frame 3 has a motor 7, and in the present exemplary embodiment, an internal combustion engine such as a diesel engine is used as the engine as a power generation device, but in another exemplary embodiment, another power generation device is used such as an electric motor, hybrid motor, or the like. The motor 7 is used to power the movements of the work machine 1, such as powering the traveling body 4 to move the work machine 1 on a ground surface.

A work tool 8, in the FIG. 1 exemplary embodiment, is attached to the revolving frame 3. Specifically, the work tool 8 is raisably and lowerably attached to the revolving frame 3 by a linkage system 9. The linkage system includes a boom 10, an arm 11 that is pivotably attached to the distal end of the boom 10, and an implement 12 that is pivotably attached to the distal end of the arm 11. The implement 12 is able to dig or hold a predetermined held object, such as earthen material. The position of the boom 10, arm 11, and implement 12 is controlled by a motor and hydraulic system 13, which includes the motor 7 and any hydraulic actuators, cylinders, and additional hydraulic motors (not shown) attached to the revolving frame 3, boom 10, arm 11, and implement 12. More specifically, the motor and hydraulic system 13 are able to raise and lower the boom 10 that is pivotably attached to the revolving frame 3, raise and lower the arm 11 that is pivotably attached to the boom 10, and raise and lower the implement 12 that is pivotably attached to the arm 11.

The work machine 1 also has a processing unit or controller 14 (FIG. 7) that includes position sensors 15 that are disposed on the linkage system 9, revolving frame 3, and base body 2 of the work machine 1. The controller 14 is located on the work machine 1 or is located at a remote position from the work machine 1 and is in remote communication with the work machine 1, such as through a cloud based computing system or wireless computing system. The position sensors 15 may include any one or more of inertial measurement units (IMUs) sensors, Anisotropic Magneto-Resistive (AMR) sensors, potentiometer sensors, one or more 2D cameras, 3D stereo camera, a LiDar camera, an ultrasonic distance sensing sensor, or a millimeter-wave radar, or may include a combination of two or more of any of these cameras/sensors. The position sensors 15 create sensor data 16 that may include position information for determining the position of the work machine 1, linkage system 9, work tool 8, revolving frame 3, or base body 2 with respect to a reference in the environment and/or for determining the position of the body of the work machine 1.

Figure 2:
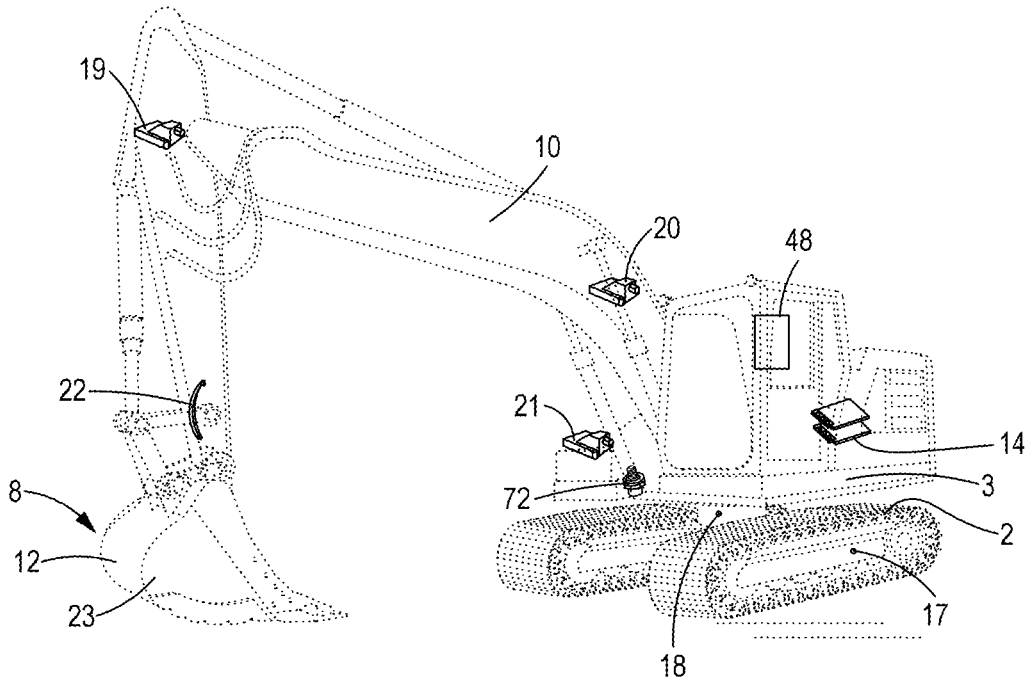
FIG. 2 is a side view of the exemplary work machine having position sensors, in accordance with the present disclosure.

As best shown in FIG. 2, the method of measuring the position and posture of the body of the work machine 1, including the work tool 8, linkage system 9, revolving frame 3, and base body 2, may use a variety of position sensors. For example, the base body 2 (or revolving frame 3) may have a receiver sensor 17 that is a GNSS (Global Navigation Satellite System/Global Positioning Satellite System) receiver to measure the body position and left and right inclination of the base body 2 or revolving frame 3. The swing between the revolving frame 3 and the base body 2 may be measured by a swing angle sensor 18, or a revolving frame position sensor 21 may measure the inertia or position of the revolving frame 3. Rotation angles, inclination angles, and positioning relative to the revolving frame 3 and base body 2 of the boom 10, arm 11, and implement 12 (and relative to each other) are measured by the position sensors located in the boom 10, arm 11, and implement 12 respectfully. The linkage system 9 and work tool 8 position sensors include a boom position sensor 20 located on the boom 10, an arm position sensor 19 located on the arm 11, and a bucket position sensor 22 located on a bucket 23 of the work tool 8, or located on the arm 11 close to where the arm 11 is attached to the work tool 8. The swing angle sensor 18, revolving frame position sensor 21, boom position sensor 20, arm position sensor 19, and bucket position sensor 22 send their measured sensor data 16 to the controller 14, as discussed below.

Figure 3:
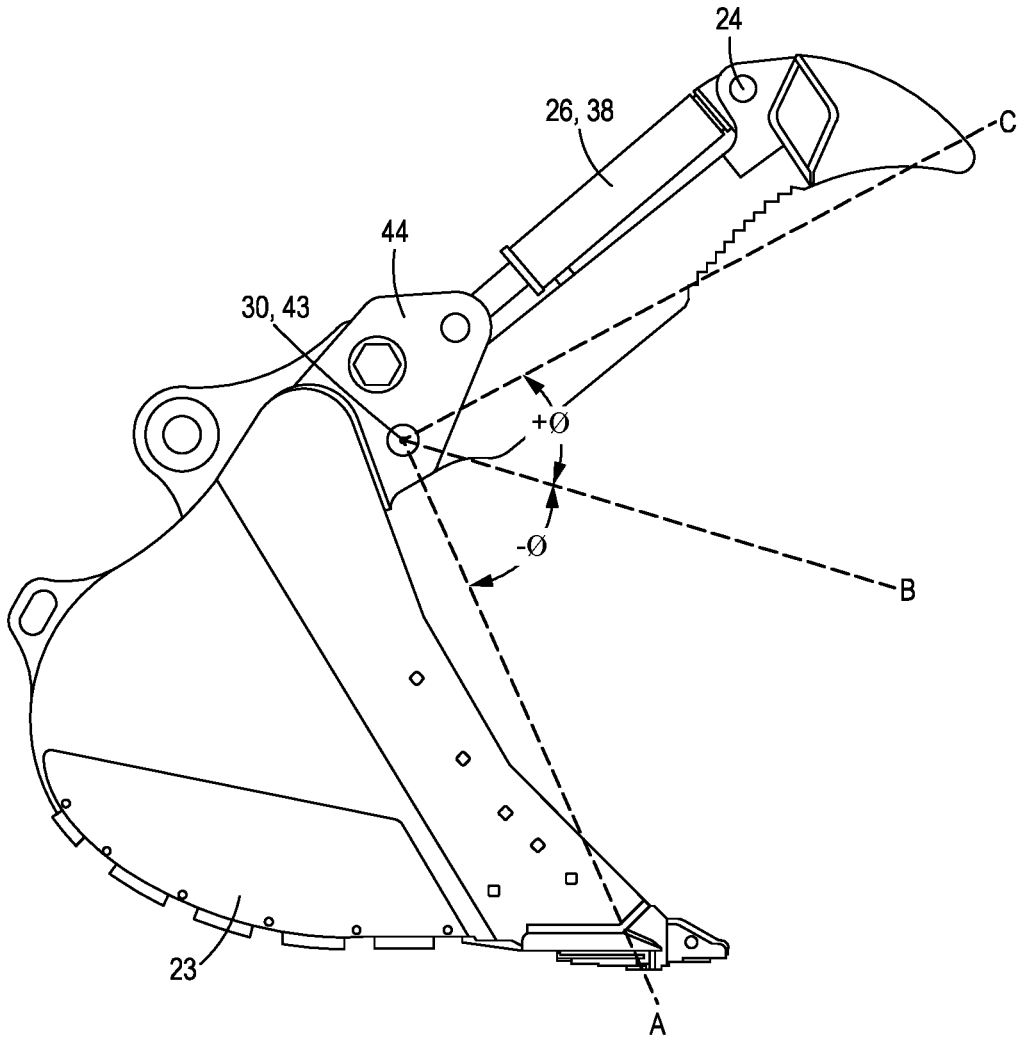
FIG. 3 is a side view of a work tool for the work machine, in accordance with the present disclosure.
Figure 4:
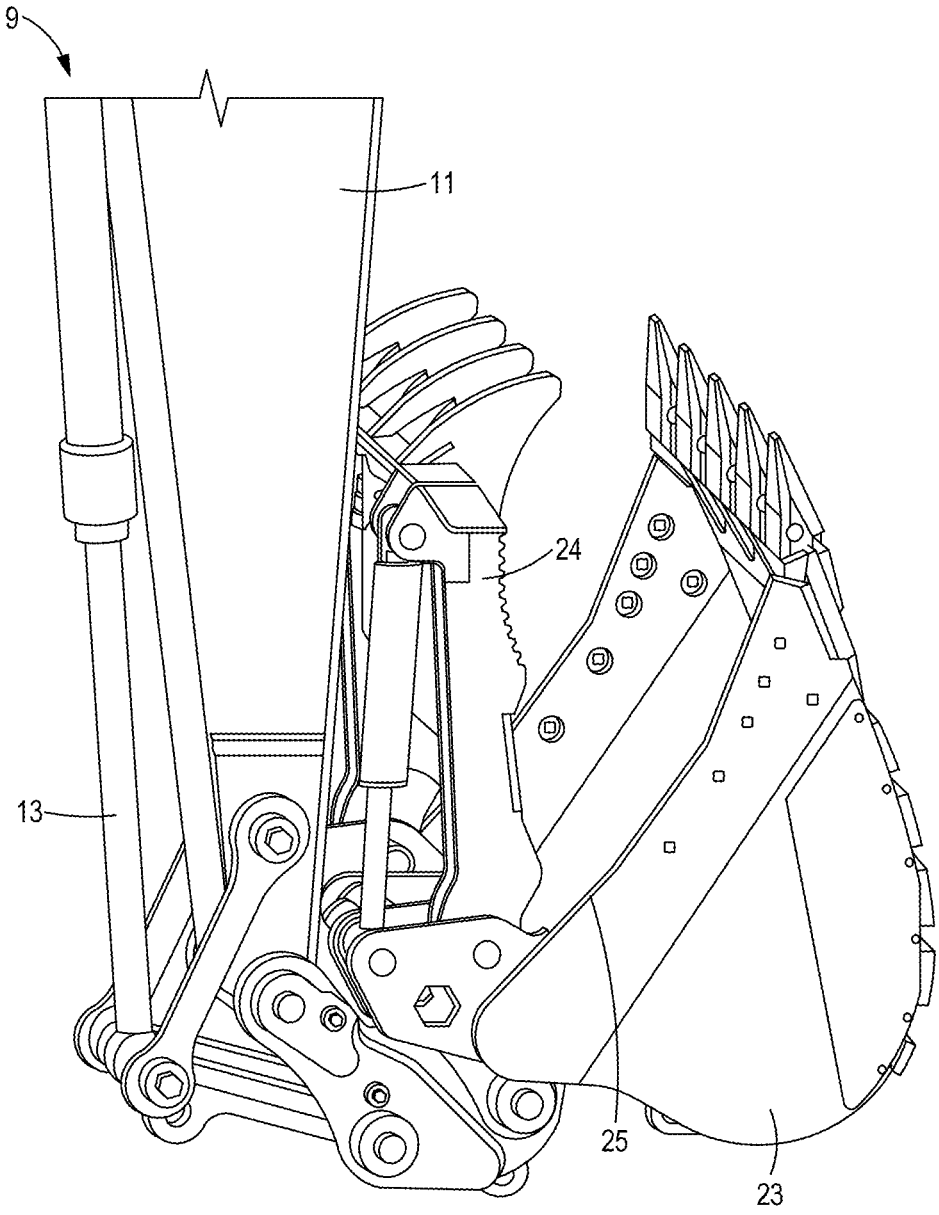
FIG. 4 is a side view of the work tool in a curling position, in accordance with the present disclosure.

As shown in FIG. 3, the implement 12 is a work tool 8 that has a bucket 23 and an attached thumb 24 (FIGS. 3-4). The thumb 24 may be pivotally attached to the arm 11 (FIGS. 5-6), or as shown in the FIG. 3 and FIG. 4 exemplary embodiment, is pivotally attached to the work tool 8. The thumb 24 position is controlled by the hydraulic system 13, and specifically the work tool hydraulic system 26, which includes a hydraulic cylinder 38. In the FIGS. 3-4 exemplary embodiment, two hydraulic cylinders 38 are shown, with each hydraulic cylinder 38 located on each side of the thumb 24, but in another exemplary embodiment, any number of hydraulic cylinders 38 required to rotate the thumb 24 may be used. Each of the hydraulic cylinders 38 shown in the FIGS. 3-4 embodiment are connected to the bucket frame 44 and the thumb 24, and extend to close the thumb 24 and retract to open the thumb 24. In one exemplary embodiment, the thumb 24 may be a non-link thumb, a progressive link thumb, or a full-rotation thumb.

In FIG. 3 the work tool 8 is shown with an attached thumb 24 in at least one open position. However, it is to be understood that the work tool 8 may be moveable, or positionable, to a plurality of second positions and the thumb 24 may be moveable, or positionable, to plurality of rest or closed positions. Any number of working positions may exist between a fully open and a fully closed position of the thumb 24, which is fully rotatable between the fully open and fully closed positions, and is capable of maintaining any position in-between, and including, the fully open and fully closed positions. With reference to FIG. 4, the bucket 23 of the work tool 8 in in a curled position towards the arm 11. In a working position, the bucket 23 may be arranged to cooperate with the thumb 24 to grip an object, such as a tree trunk, for example, by moving the thumb 24 towards the bucket 23. In a resting position, the thumb 24 may be rotated downwards to resting on, or almost resting on, a top surface 25 of the bucket 23. In a fully open position, the thumb 24 may be extended away from the bucket 23 to its maximum amount allowed by the linkage system 9, the hydraulic system 13, or allowed by any of the physical connections between the thumb 24 and the work machine 1. In a further exemplary embodiment, the bucket 23 and the thumb 24 may both move towards one another to suitably or firmly grip an object between them, or may rotate together away, or towards, the arm 11 of the work machine 1.

For example, with reference to FIG. 3, the thumb 24 rotation is at a fully open articulation angle of +Ø. The articulation angle +Ø is formed by the intersection of a longitudinal axis B being a thumb 24 working position and a longitudinal axis C being a fully open position. An articulation joint 43 of the bucket frame 44 provides the connection point of the thumb 24.

A thumb position sensor 30 is used to measure the articulation angle Ø, or opening angle, between the thumb 24 and the bucket 23. The thumb position sensor 30, as depicted in this exemplary embodiment, is located at the articulation joint 43, but in other embodiments, is located on the arm 11 or the work tool 8. This measurement includes the thumb 24 in a fully open position of longitudinal axis C, a fully closed position of a longitudinal axis A, or any angle in-between (working position). Longitudinal axis B is shown as an exemplary working position axis, but the thumb 24 is fully rotatable between the longitudinal axis A and the longitudinal axis C. For example, the longitudinal axis C is an exemplary fully open position axis, although this axis as depicted is purely for exemplary purposes and is non-limiting as the longitudinal axis C may be up to 180 degrees. As depicted in the exemplary embodiment shown in FIG. 3, a fully closed articulation angle –Ø, shown in phantom lines in FIG. 3, is a mirror image of the fully open articulation angle +Ø.

Figure 5:
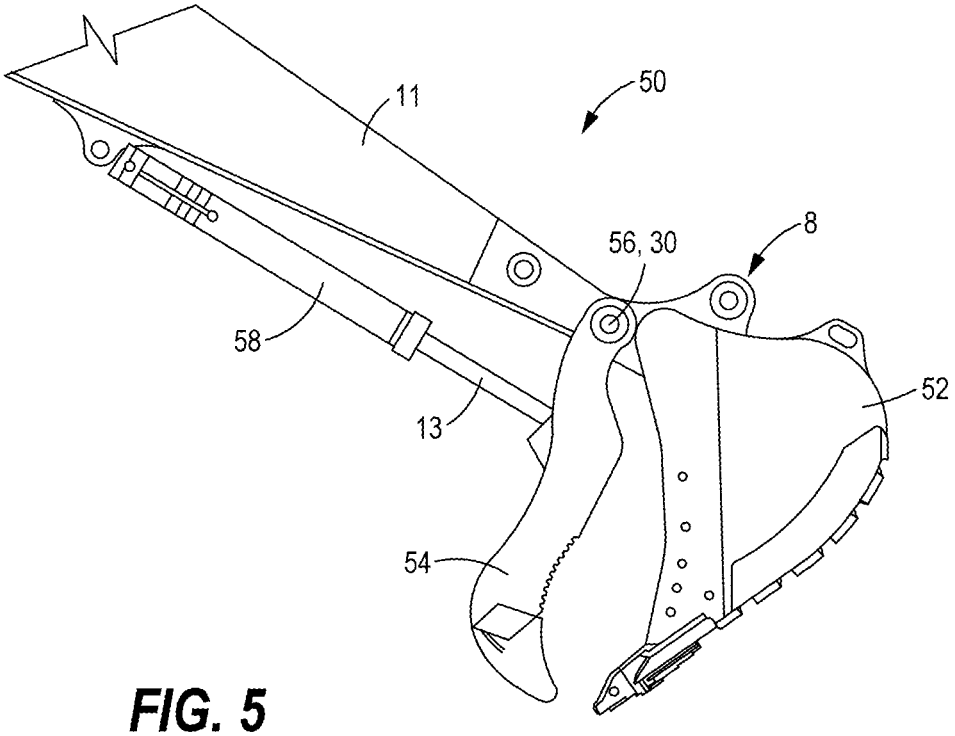
FIG. 5 a side view of another exemplary embodiment of a work tool for the work machine, in accordance with the present disclosure.
Figure 6:
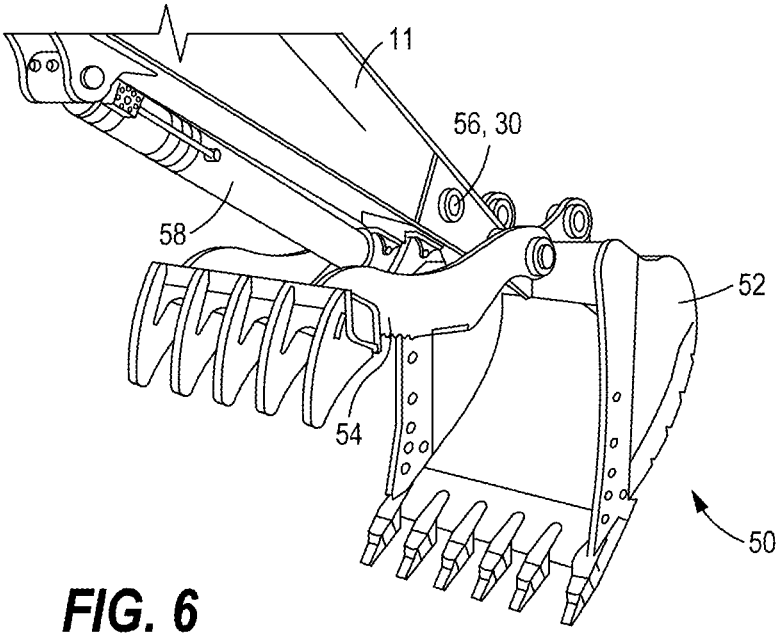
FIG. 6 is perspective view of the work tool of FIG. 5, in accordance with the present disclosure.

As shown in FIG. 5 and FIG. 6, the thumb 24 may be a non-link thumb 53. In the FIG. 5-6 exemplary embodiment of a work tool 50 attached, or coupled, to the work machine 1, the work tool 50 has a bucket 52 that is attached, or coupled, to the arm 11 of the work machine 1. The work tool 50 also includes a thumb 54 that is attached, or coupled, to the arm 11 at the pivot attachment point 56, as opposed to the frame of the bucket as depicted in the FIGS. 3-4 embodiment. The thumb 54 is rotatable relative to the arm 11 in the directions towards the arm 11 and towards the bucket 52. The position of the thumb 54 is controlled by a cylinder 58, or hydraulic cylinder, of the hydraulic system 13, which itself is controlled by the controller 14. The thumb position sensor 30 is located at the pivot attachment point 56, but in other embodiments, is located on the arm 11 or the work tool 8. In one exemplary embodiment, the thumb position sensor 30 measures the opening angle of the thumb relative to an axis of a top surface 25 of the bucket 23, which is depicted as longitudinal axis A in the FIG. 3 exemplary embodiment.

Figure 7:
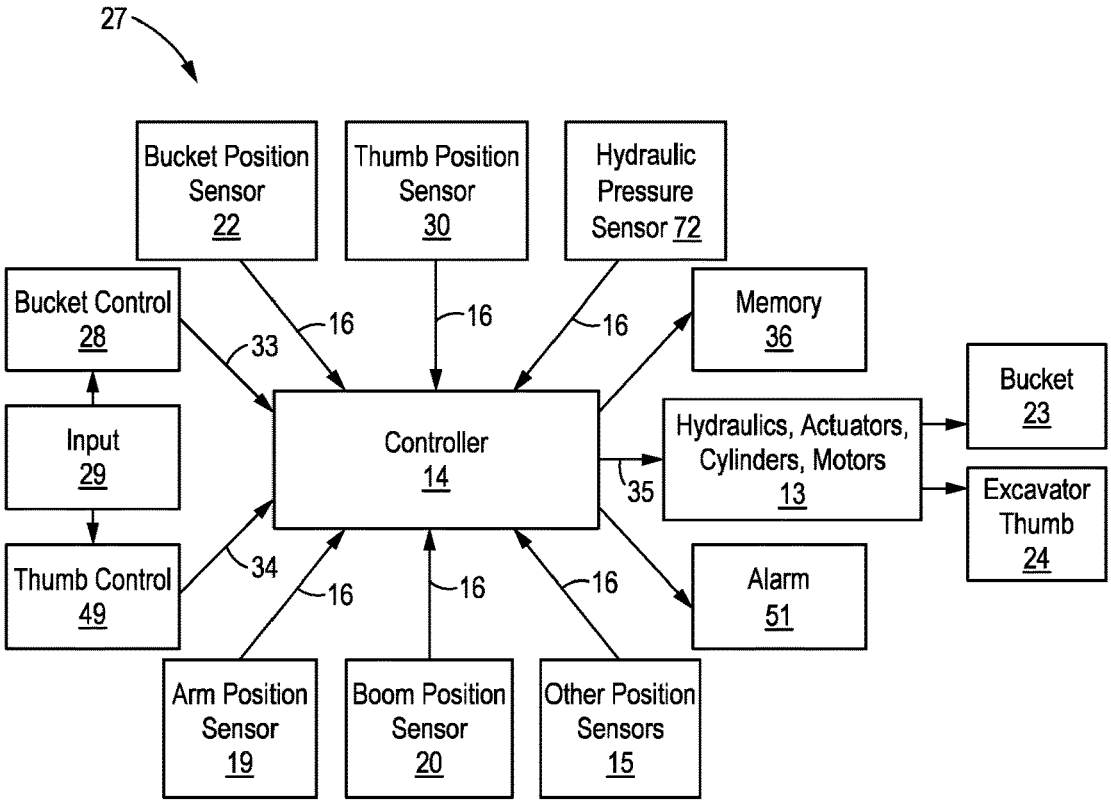
FIG. 7 is a block diagram of a work tool control for the work machine, in accordance with the present disclosure.

Turning to FIG. 7, a schematic block diagram of a work tool position control 27 of the work machine 1 is shown. The work tool position control 27 includes the thumb position sensor 30 for sending the measurement of the opening angle between the thumb 24 and the bucket 23 to the controller 14. The controller 14 utilizes this measurement in many of the machine operations described below. The work tool position control may include a bucket control 28, a thumb control 49, the controller 14, the thumb position sensor 30, and a machine implement movement signal, such as a bucket movement signal 33 or a thumb movement signal 34, to allow the controller 14 to receive the measured opening angle and movement signals prior to the controller 14 moving the work tool 8.

The work tool position control 27 is used to control the positioning of the work tool 8 (including the boom 10, arm 11, and bucket 23), any revolving frame 3 of the work machine 1, and any traveling body 4 for positioning any work machine 1. To control these positionings, the work tool position control 27 first receives a movement signal from the operator controls 6, and specifically the bucket control 28 of the operator controls 6, located inside of the operator cab 5, based on an input 29 received at the operator controls 6 from an operator of the work machine 1. After receiving the bucket movement signal 33, the work tool position control 27 sends an actuation signal 35 to the motor and hydraulic system 13. The motor and hydraulic system 13, upon receiving the actuation signal 35, then actuates the hydraulic cylinders located on the linkage system 9 which move the work tool 8. The motor 7 of the motor and hydraulic system 13, upon receiving the actuation signal 35, may be used to power the movements of the base body 2 and the revolving frame 3, or any other movements of the work machine 1 depending on the type of construction machine is used.

In one exemplary embodiment, the bucket control 28 is configured to adjust the bucket 23 of the work tool 8 relative to the arm 11 of the work machine 1 by sending the bucket movement signal 33 to the controller 14 after receiving the input 29 from the operator indicating a desired movement of the bucket 23. Prior to the controller 14 sending the actuation signal 35 to the hydraulic system 13 to move the bucket 23, the controller 14 receives the sensor data 16 from the bucket position sensor 22 and the thumb position sensor 30, and is thus monitoring these sensors, to calculate from the received sensor data 16 and determine a real-time position of the bucket 23 and the thumb 24 relative to each other and the rest of the work machine 1. In this example, the real-time position of the bucket 23 is calculated and determined from the measurements received from the bucket position sensor 22, and the real-time position of the thumb 24 is calculated and determined from the measurements received from the thumb position sensor 30. In one exemplary embodiment, a memory 36 is in operative connection with the controller 14, and data, such as work tool parameter data, relating to the operative parameters, also referred to as the work tool parameters, of the thumb 24, including its length, width, shape, number of teeth, model number, manufacturer, and all other physical characteristics of the thumb 24, is stored in the memory 36. The controller 14, in this exemplary embodiment, can retrieve the operative parameter data, and along with the measurements received from the sensor data 16 from the thumb position sensor 30, calculate the present position of the thumb 24. In another exemplary embodiment, the measurements from the thumb position sensor 30 is all that is needed to calculate the present position of the thumb 24 relative to the bucket 23.

The controller 14, after determining the present position of the bucket 23 and the thumb 24, then calculates a future bucket position based upon the received bucket movement signal 33. In one exemplary embodiment, after calculating the future position of the bucket 23, the controller 14 determines the future position of the thumb 24 as it has determined the present location of the thumb 24, and the thumb 24 is attached to the bucket 23. In another exemplary embodiment, the controller 14 also calculates a future thumb position, or where the thumb will be physically located after the bucket 23 the thumb is attached to is moved, based on the bucket movement signal 33.

If the controller determines that the movement of the bucket 23 in accordance with the bucket movement signal 33 will result in the thumb 24 coming into interference with the arm 11, the controller 14 sends a thumb movement signal 34 to the hydraulic system 13 to actuate the thumb 24 to move away from the arm 11, and towards the bucket 23. In this exemplary embodiment, the thumb 24 may be rotated to a position sufficient to prevent interference between the thumb 24 and the arm 11, or may be rotated fully to the closed position.

In another exemplary embodiment, if the controller determines that the movement of the bucket 23 in accordance with the bucket movement signal 33 will result in the thumb 24 coming into interference with the arm 6, the controller 14 may limit, or completely stop travel, and thus movement, of the bucket 23 while repositioning the bucket 23 in accordance with the bucket movement signal 33. Similarly, if the controller determines that movement of the bucket 23, or movement of the thumb 24, as commanded by the bucket movement signal 33 or a thumb movement signal 34 for controlling movement of the thumb 24, respectfully, will result in the thumb 24 or the bucket 23 coming into contact with any part of the work machine 1, the controller 14 may limit, or completely stop travel, and thus movement, of the bucket 23, the thumb 24, or both. In one exemplary embodiment, if the controller 14 determines from a future calculated bucket position that the thumb 24 would interfere, or contact, the operator cab 5, or any part of the work machine 1, then the controller would either rotate the thumb 24 away from the operator cab 5, or the part to the work machine 1 that the thumb 24 would interfere with, or limit, or completely stop travel, of the bucket 23. In another exemplary embodiment, if the controller 14 determines that a future calculated thumb 24 position, after movement of the thumb 24, that the thumb 24 would interfere with the operator cab, or any other part of the work machine 1, then the controller would either rotate the thumb 24 away from the operator cab 5, or the part to the work machine 1 that the thumb 24 would interfere with, or limit, or completely stop travel, of the thumb 24.

After moving the thumb 24 position towards the bucket 23, the controller 14 then sends the actuation signal 35 to the hydraulic system 13 to move the bucket 23 in accordance with the bucket movement signal 33.

In an even further exemplary embodiment, if the controller receives a thumb movement signal 34 generated by the thumb control 49 (the input 29 received at the thumb control 49 on the operator controls 6), and the controller 14 determines based on the received sensor data 16, or calculated future positions of the bucket 23 or thumb 24, that the actuation of the thumb 24 to a more open position will cause the thumb 24 to interfere with any part of the work machine 1, or specifically in the exemplary example, the arm 11, then the controller 14 will prevent further opening, or limit opening, of the thumb 24 to prevent interference. Further in this embodiment, if the controller 14 determines that the further opening of the thumb 24 will cause, or may cause the interference of the thumb 24 with the work machine 1, the controller 14 will send an alarm signal 68 to an alarm 51 located in the operator cab 5 to provide a warning to the operator. The alarm 51 may be displayed on an operator display 48 or the operator controls 6 in the operator cab 5, or it may be status light in the operator cab 5, or audible alarm. If the operator continues the movement of the thumb 24 after the alarm signal 68 has been sent, the controller 14 can stop movement of the thumb 24.

In order to keep the thumb 24 in a fully open position, as much as possible, to prevent the thumb 24 from getting in the way of working operations when it is not needed, such as in a digging operation, the controller 14 may monitor the bucket position sensor 22, the thumb position sensor 30, the arm position sensor 19, the boom position sensor 20, or any of the other beforementioned position sensors to determine if any movement of the implements of the work machine 1 will cause the thumb 24 to interfere with any surface or other implements of the work machine 1, including the arm 11, boom 10, operator cab 5, revolving frame 3, or base body 2. Thus, the position sensors are able to provide sensor data 16 of the positions of the linkage system 9, base body 2, and revolving frame 3, relative to the work tool 8, to the controller 14 in determining future positions of the work tool 8 relative to work machine 1 to prevent interference. The controller 14, in accordance with the procedures outlines above, may automatically move the thumb 24, or prevent movements of the work tool 8 that would cause interference, including limiting or stopping movement of the bucket 23 to prevent interference. Further in this embodiment, if the controller 14 determines that the further movement of the bucket 23 will cause, or may cause the interference of the bucket 23 with the work machine 1, the controller 14 will send the alarm signal 68 to the alarm 51 located in the operator cab to provide a warning to the operator. If the operator continues the movement of the bucket 23 after the alarm signal 68 has been sent, the controller 14 can stop or dampen movement of the bucket 23.

Besides prevention of interference between the work tool 8, and the thumb 24 of the work tool 8, with the work machine 1, the thumb position sensor 30 in operable connection with the controller 14 of the work machine 1 measurements of the opening angle enables many features. For example, predetermined positions of the thumb 24 relative to the bucket 23 are enabled by knowing the angle between the thumb 24 and the bucket 23. In this example, the operator of the work machine 1 during a working operation may desire the thumb to quickly change to a predetermined position, or predetermined opening angle, of the thumb 24 relative to the bucket 23. The predetermined position may be any position of the thumb 24 relative to the bucket 23, including the fully open position, the fully closed position, or any position in-between. For example, if an operator desires the thumb 24 to be 30° open relative to the bucket 23, the operator using the operator controls 6 can set the predetermined position of the thumb 24 to 30°, and the controller 14 will rotate the thumb 24 to this desired opening angle. The operator may either use the operator controls 6 to command the thumb 24 to move to the predetermined position, or the operator controls 6 may be set so that the controller 14 automatically returns the thumb 24 to the predetermined position after each movement of the thumb 24 commanded by the controller 14 is completed.

Using the predetermined positions of thumb 24 enabled by the thumb position sensor as described above, the operator of the work machine 1 can save thumb 24 positions, such as working positions, fully open, or fully closed, for example, in the memory 36. In this embodiment, the thumb 24 may automatically be repositioned to the saved location after the thumb 24 had been moved by the controller 14 to avoid any interference. The thumb 24 automatically returning to the saved thumb position after the distance between the thumb 24 and the work machine 1 is great enough that returning to the saved position will not cause an interference.

Further, the measurements of an object, such as a tree trunk, for example, are enabled by the thumb position sensor 30. In this exemplary embodiment, after gripping the object between the thumb 24 and the bucket 23, the controller 14 receives the measurement of the opening angle between the thumb 24 and the bucket 23. In the memory 36, the dimensions of the bucket 23, including its length, and the dimensions of the thumb 24, including its length, are stored, and this parameter data of the work tool 8 are sent to the controller 14. With the parameter data and the measurements of the opening angle, the controller 14 can calculate and determine a size, such as a length or width, of the object being gripped. This measurement may be calculated from the tips of thumb 24 to the tip of the bucket 23, or may be calculated from the contract point of the object on the bucket 23 to the contact point of the object on the thumb 24.

The thumb position sensor 30 further enables soft closing thumb 24 as the thumb 24 is moved to its fully closed position. The thumb position sensor 30 may continuously measure the opening angle, and as the thumb 24 approaches its fully closed position when rotated, the controller 14 may slow down, or decrease, the rotation speed of the thumb 24 to prevent the thumb 24 from closing too fast or with too much force against the bucket 23. This speed may be variable, with the thumb 24 slowing the rotation speed of the thumb 24 at a greater rate the closer the thumb 24 gets towards the bucket 23. In one exemplary embodiment, the thumb 24 may be in a first position, such as a working position or fully open position, and is rotated by the controller 14 towards the bucket 23 at a first rate. After the thumb 24 reaches a second position having a smaller opening angle than the first position, the controller 14 rotating the thumb 24 at a second rate that is less than the first rate. In an even further exemplary embodiment, as the thumb 24 approaches the bucket 23 it reaches a third position, and the controller 14 rotates the thumb 24 at a third rate that is less than the second rate. Additionally, as the thumb position sensor 30 measures that the thumb 24 is moving away from the fully open or fully closed positions, the controller 14 will increase the rotation speed of the thumb 24.

Also enabled by the thumb position sensor 30, when any thumb 24 movement, relative to the bucket 23, is measured by the thumb position sensor 30, and this movement has not been commanded by the controller 14, the controller 14 receives this measured movement, indicated by an increasing or a decreasing opening angle between the thumb 24 and the bucket 23, and the controller 14 sends out the alarm signal 68 to the operator control 6 in the operator cab 5 to be displayed, or heard as an audible alarm, indicating the thumb 24 is moving despite no movement commands had been received by the controller 14. Unintentional movement 24 of the thumb 24 may indicate an error in the work machine 1, for example, a leak in the hydraulic system, mechanical failure, or external force has been applied to the work tool 8.

The thumb position sensor 30 also enables pressure monitoring and variability in the hydraulic system 13, and specifically the hydraulics that control the rotation of the thumb 24. In one exemplary embodiment, they hydraulic cylinder 38, which is part of the work machine's 1 hydraulic system 13 generally, and the work tool hydraulics 26 narrowly, is used for rotating the thumb 24 around its pivoted connection. The hydraulic cylinder 38, or hydraulic system 13, contains a hydraulic pressure sensor 72 that measures the pressure of the hydraulic fluids in the hydraulic cylinder 38 during the rotation of the thumb 24. This measurement is sent to the controller 14, and during rotation of the thumb 24, the controller 14 adjusts the pressure supplied to the hydraulic cylinder 38 to provide an even closing, or opening, force of the thumb 24 to prevent variability of the forces applied by the thumb 24. In one exemplary embodiments, the pressure measurements supplied by the hydraulic pressure sensor 72 to the controller 14 are utilized by the controller 14 to calculate the clamping forces of the thumb 24, and the controller 14 adjusting the hydraulic fluid supplied to the hydraulic cylinder 38 to minimize variability in these forces.

INDUSTRIAL APPLICABILITY

In general, the teachings of the present disclosure may find applicability in many industries including, but not limited to, heavy machinery. More specifically, the teachings of the present disclosure may find applicability in any industry using excavators, or electric mining shovels, in a digging operation, such as, but not limit to, construction, excavating, agriculture, and the like.

In accordance with the scope of the present disclosure, in one such operation it is desirable to prevent the thumb 24 from contacting and damaging the arm 11, or any other part of the linkage system 9, when the bucket 23 is moved, such as during the curling of the bucket 23 when the thumb 24 is in an open position. In order to prevent damage to the linkage system 9, the present disclosure provides a method for autonomously adjusting the thumb 24 position prior to thumb 24 interfering with the linkage system 9 during the moving of the work tool 8.

Figure 8:
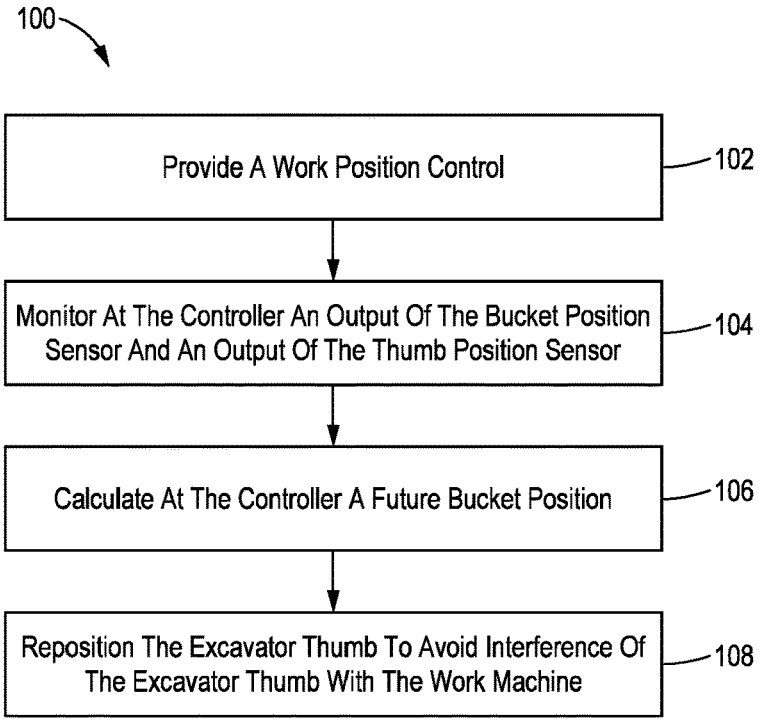
FIG. 8 is a flow chart illustrating an autonomous method of moving the thumb of the work tool, in accordance with the present disclosure.

Turning now to FIG. 8 with continued reference to FIGS. 1-7, a flowchart illustrating an exemplary method 100 for autonomously repositioning the thumb 24 relative to a bucket 23 is shown. At block 102, the work tool position control 27 having the bucket position sensor 22, the thumb position sensor 30, and the controller 14 is provided. The work tool position control 27 is configured to rotate the bucket 23 relative to the arm 11 of the work machine 1 after receiving the bucket movement signal 33.

Prior to rotating the bucket 23, at block 104 the controller 14 monitors an output of the bucket position sensor 22 and the thumb position sensor 30. At block 106, the controller 14 calculates a future bucket 23 position.

Once the future bucket position 23 is calculated, the controller 14 repositions thumb 24 to avoid interference of the thumb 24 with the arm 11 as the bucket 23 is rotated in response to the bucket movement signal 33.

While the preceding text sets forth a detailed description of numerous different embodiments, it should be understood that the legal scope of protection is defined by the words of the claims set forth at the end of this patent. The detailed description is to be construed as exemplary only and does not describe every possible embodiment since describing every possible embodiment would be impractical, if not impossible. Numerous alternative embodiments could be implemented, using either current technology or technology developed after the filing date of this patent, which would still fall within the scope of the claims defining the scope of protection.

What is claimed is:

1. A work tool position control, comprising:

a bucket control for controlling a movement of a bucket of a work tool of a work machine, and the bucket control configured to send a bucket movement signal to a controller;

a thumb position sensor configured to measure an opening angle between a thumb of the work tool and the bucket, the thumb position sensor configured to send the measured opening angle to the controller; and the controller configured to receive the measured opening angle, calculate a future bucket position based on the received bucket movement signal, and move the bucket in response to the bucket movement signal.

2. The work tool position control of claim 1, in which prior to the movement of the bucket, the controller monitors a bucket position sensor and the thumb position sensor to determine a present position of the bucket and the thumb, and adjust the work tool during the movement of the bucket to prevent interference of the thumb and the work machine.

3. The work tool position control of claim 2, in which the movement of the bucket is a rotation of the bucket towards an arm of the work machine, and the controller is configured to adjust the work tool during the movement of the bucket by rotating the thumb away from the arm to prevent an interference of the thumb and the arm.

4. The work tool position control of claim 3, in which prior to the movement of the work tool, a future thumb position is calculated by the controller from the received measured opening angle, and after the future thumb position the controller determines if the future thumb position interferes with the work machine.

5. The work tool position control of claim 2, in which the controller is configured to adjust the work tool during the movement of the bucket by dampening or stopping the movement of the bucket to prevent an interference between the work tool and the work machine.

6. The work tool position control of claim 1, in which the controller is configured to prevent rotation of the thumb after receiving a thumb movement signal from a thumb control if a future position of the thumb would be in interference with the work machine, the future position of the thumb calculated by the controller from the measured opening angle and sensor data received from a bucket position sensor.

7. The work tool position control of claim 1, in which during the movement of the bucket, the controller is configured to dampen or stop the movement of the bucket when the controller determines based on a calculated future bucket position that the work tool is in an interfere with the work machine.

8. A work machine, comprising:

a base body configured to be supported on a ground surface;

a revolving frame coupled to the base body and rotatable about an axis;

an arm coupled to the revolving frame;

a bucket of a work tool pivotally coupled to the arm, the bucket positionable relative to the arm by a bucket control;

a thumb of the work tool rotatable relative to the bucket, the thumb positionable relative to the bucket by a thumb control; and a controller configured to move the bucket upon receiving a bucket movement signal from the bucket control, and prior to moving the bucket the controller configured to monitor a thumb position sensor configured to measure an opening angle between the thumb and the bucket, and calculate a future bucket position based upon the received bucket movement signal.

9. The work machine of claim 8, in which prior to moving the bucket, the thumb control is configured to be set to a predetermined position, after the predetermined position is set the thumb control sending a thumb movement signal to the controller, the controller calculating the thumb movement from the measured opening angle to the predetermined position, and the controller moving the thumb to the predetermined position.

10. The work machine of claim 8, in which the work tool is configured to grip an object between the bucket and the thumb, the controller receiving the measured opening angle from the thumb position sensor after the object is gripped to determine a size of the gripped object.

11. The work machine of claim 8, in which the controller is configured to rotate the thumb of the work tool and decrease the speed the thumb rotates as the thumb approaches a fully open position or a fully closed position.

12. The work machine of claim 8, in the controller is configured to send an alarm signal to an operator control of the work machine if the thumb position sensor determines movement of the thumb prior to the controller sending a thumb movement signal.

13. The work machine of claim 8, in which the controller automatically moves the thumb away from the work machine during the moving of the bucket if the controller determines that the calculated future bucket position will cause the thumb to interfere with an operator cab of the work machine.

14. The work machine of claim 8, in which the work machine further includes a boom position sensor, and the controller is configured to automatically move the thumb away from a boom of the work machine during the moving of the bucket if the controller determines that a future bucket position is in interference between the thumb and the boom.

15. The work machine of claim 8, in which the work machine further includes a swing angle sensor, and the controller is configured to automatically move the thumb away from the revolving frame of the work machine during the moving of the bucket if the controller determines that the future bucket position is in interference between the thumb and the revolving frame.

16. The work machine of claim 8, in which the thumb is coupled to an articulation point of a frame of the bucket and is rotatable around the articulation point by a hydraulic cylinder of a hydraulic system, the hydraulic system having a hydraulic pressure sensor that sends pressure measurements of the hydraulic system to the controller, and the controller configured to adjust a pressure of the hydraulic cylinder during the rotating of the thumb to provide even force through the rotation of the thumb.

17. The work machine of claim 8, in which a memory is in operable communication with the controller, a work tool parameter being stored on the memory, and the controller calculating the adjusting of the pressure from the work tool parameter data and the pressure measurements.

18. A method for autonomously repositioning a thumb of a work machine relative to a bucket, the method comprising:

providing a work tool position control having a bucket position sensor, a thumb position sensor, and a controller, the work tool position control configured to rotate the bucket relative to an arm of the work machine after receiving a bucket movement signal;

prior to rotating the bucket, monitoring at the controllers sensor data received from the bucket position sensor and the thumb position sensor;

prior to rotating the bucket, calculating at the controller a future bucket position based upon the received bucket movement signal; and moving the thumb to avoid interference of the thumb with the arm as the bucket is rotated in response to the movement signal.

19. The method of claim 18, in which the bucket is rotated towards the arm of the work machine and the thumb is repositioned to a closed position.

20. The method of claim 18, in which the controller is configured to send an alarm signal to an operator control of the work machine when the controller repositions the thumb.

* * * * *